United States Patent [19]

Demonsablon et al.

[11] Patent Number: 4,472,130

[45] Date of Patent: Sep. 18, 1984

[54] DEVICE FOR RAISING A CASTING TABLE, MORE ESPECIALLY FOR CONCRETE PANELS

[75] Inventors: Philippe Demonsablon; Jean Millot; André Corneloup, all of Le Plessis Robinson, France

[73] Assignee: Societe d'Etudes Techniques et d'Entreprises Generales-Sodeteg, France

[21] Appl. No.: 396,343

[22] Filed: Jul. 8, 1982

[30] Foreign Application Priority Data

Jul. 24, 1981 [FR] France ..... 81 14423

[51] Int. Cl.[3] ..... B28B 7/08

[52] U.S. Cl. ..... 425/436 RM; 425/439; 425/454

[58] Field of Search ..... 425/436 RM, 439, 453, 425/454; 33/444

[56] References Cited

U.S. PATENT DOCUMENTS

| | | | |
|---|---|---|---|
| 415,691 | 11/1889 | Svenson | 33/444 |
| 2,244,391 | 6/1941 | De Lisle | 33/444 |
| 4,149,697 | 4/1979 | Linetsky | 425/439 X |
| 4,181,485 | 1/1980 | Schramm | 425/439 X |

FOREIGN PATENT DOCUMENTS

| | | | |
|---|---|---|---|
| 2338666 | 2/1975 | Fed. Rep. of Germany | 425/456 |
| 63585 | 9/1955 | France . | |
| 591319 | 2/1978 | U.S.S.R. | 425/439 |

*Primary Examiner*—Donald E. Czaja
*Assistant Examiner*—James C. Housel

[57] ABSTRACT

The invention provides devices for raising a table for casting a concrete panel so as to be able to remove it from the mold. Such a raising device is provided with a funicular cable passing over an assembly of pulleys. Two carriages carried by two strands of this funicular cable travel perpendicularly to the pivoting axis of the table and with an identical movement. Two links are pivotably mounted on these carriages and on the lower face of the table so as to synchronize the raising movement of said table.

6 Claims, 6 Drawing Figures

DEVICE FOR RAISING A CASTING TABLE, MORE ESPECIALLY FOR CONCRETE PANELS

BACKGROUND OF THE INVENTION

The present invention relates to devices for raising a casting table for swinging such a table from a horizontal position for casting, more especially concrete panels, to a vertical position for stripping this panel from the mold.

It is known in the building industry to prefabricate concrete panels, serving for example as frontage wall, internal partition wall, gables or floors by casting these panels on a table serving as mold. To facilitate the casting operation, this table is placed in the horizontal position. After drying, generally by baking the panels, the table is raised so as to be able to remove them from the mold. This raising is achieved by causing the table to pivot about one of its sides and by exerting for example a pull by means of a sling and a winch on the other side. It is practically impossible to construct a casting table whose rigidity is such that it does not bend under the load when it is raised or that it does not buckle under the differential effect of the varying amounts of flexion along the members. These flexions often cause a breakage or the beginnings of breakage, of the panel which has been cast. To limit this breakage, use is made of an assembly of cylinder and piston devices, or jacks, preferably hydraulic, which exert balanced thrusts at different points of the table. Experience shows that even under ideal conditions, the balance between the different thrusts is not always obtained and that if the work surface is loaded in a disordered manner, the imbalance further increases the percentage of rejects which becomes considerable.

SUMMARY OF THE INVENTION

To synchronize the thrusts and the movements of such a table, the invention proposes a device for raising a casting table, of the type comprising means for raising the table by causing it to pivot about a first pivot parallel to one of its sides, further comprising principally: two synchronization pulleys whose axes are parallel to the pivoting axis of the table; two first change of direction pulleys; two second change of direction pulleys; a funicular cable mounted on these pulleys and having between respectively the synchronization pulleys and the first change of direction pulleys two synchronisation strands perpendicular to the pivoting axis and situated in the same plane, and between respectively the first and second change of direction pulleys two other crossed strands so that the synchronization strands move in the same direction between the synchronization pulleys and the first change of direction pulleys; two synchronization take-offs respectively on the two synchronization strands at the same distance from the synchronization pulleys; and rigid connection means fixed on one side to the synchronization take-offs and on the other to the casting table.

BRIEF DESCRIPTION OF THE DRAWINGS

Other features and advantages of the invention will appear clearly from the following description given with reference to the accompanying figures which show.

DESCRIPTION OF THE PREFERRED EMBODIMENTS

Figure 1:
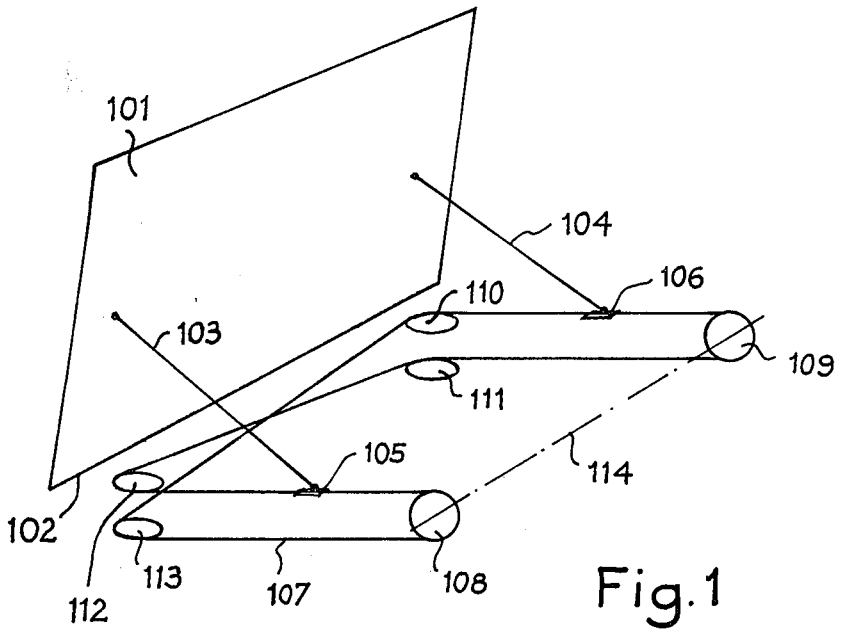
FIG. 1, a simplified diagram of the invention.

In the diagram of FIG. 1, a casting table 101 is shown in an intermediate position between the flat casting position and the upright mold stripping position. It pivots about one of its sides about an axis of rotation 102 under the action of raising means such as jacks which have not been shown.

The synchronization means which allow the thrusts to be balanced during raising comprise two links 103 and 104 of the same length which are fixed under the table at the same distance from the rotation axis 102. These links are pivotably mounted to these fixing points at one side and, at the other, to carriages 105 and 106 which slide on horizontal rails, not shown. These carriages play the role of synchronization take-offs on the cable.

The carriages are firmly fixed to a funicular cable 107 which is mounted on an assembly of pulleys 108-113 in a kinematic arrangement such that the carriages move perpendicularly to axis 102 and that the movement of one of the carriages is identical to that of the other one. Thus, when under the action for example of desynchronization of the thrust jacks with respect to one another, one of the carriages tends to advance more quickly, it will drive the other carriage through the funicular cable, which will compensate for the imbalance of the jacks.

For that, the kinematic arrangement of the funicular cable with its pulleys is similar to that for moving a ruler parallel to itself on a drawing table. Pulleys 108 and 109 have a common horizontal axis or two separate axes parallel to the axis of rotation 102 of table 101. Pulleys 112 and 113 have a vertical common axis plumb with pulley 108 with respect to axis 102 and pulleys 110 and 111 have another common vertical axis plumb with pulley 109. The funicular cable 107, extending for example from carriage 105, passes around pulley 108, goes back towards pulley 113 which is situated under pulley 112, turns through 90° under this pulley 113 and goes up towards pulley 110 which is situated above pulley 111. It turns through 90° on this pulley 110, goes towards pulley 109 while being secured on the way to carriage 106. It then winds around this pulley 109 to come back towards pulley 111, undergoes a 90° change of direction at this latter and goes up towards pulley 112 while crossing the strand which goes from pulley 113 to pulley 110. It finishes its path after a 90° change of direction at pulley 112 to return to carriage 105. It can be clearly seen that with such a kinematic arrangement, any movement of one of the carriages is transmitted to the other carriage in the same direction and with the same amplitude. The movements of the carriages are then synchronized, as well as the movements of the bearings points of the links on the table since these links are of constant length as is the distance between these bearing points and the axis of rotation 102.

An improvement for avoiding slipping of the cables on the pulleys and limiting the effects of the elasticity of these cables consists in firmly securing (by keying for example) pulleys 108 and 109 on the same shaft 114. Thus, as pulleys 108, 109, pulleys are used having a self-blocking V shaped groove which prevents the cable from slipping in this groove. Pulleys 110 and 113 may have a groove of any shape, round for example, which is easier to manufacture. With this improvement, any number of identical devices may be placed in parallel, which allows the number of synchronizing points to be multiplied for raising tables of very large size or allows tables to be placed in series. For that, these devices are placed at the side of each other with, for each one, two links and a funicular cable. The movement of the cables, and so of the whole of the devices is synchronized by the monolithic or composite shaft 114 which is common to all the devices and which causes synchronization through the pulleys of all the devices homologous with pulleys 108 and 109.

Figure 2:
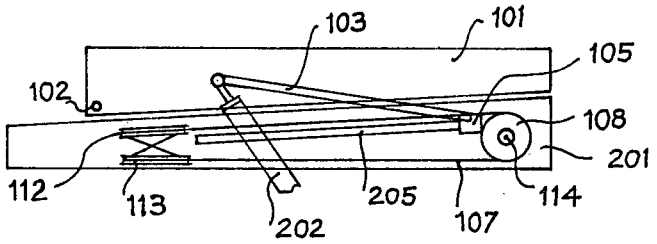
FIGS. 2 and 3, two side views of a first embodimanet of the invention in respectively lowered and raised positions, FIGS. 4 and 5, two side views of a second embodiment of the invention respectively in lowered and raised positions, and FIG. 6, a front view of this second embodiment in the lowered position.
Figure 3:
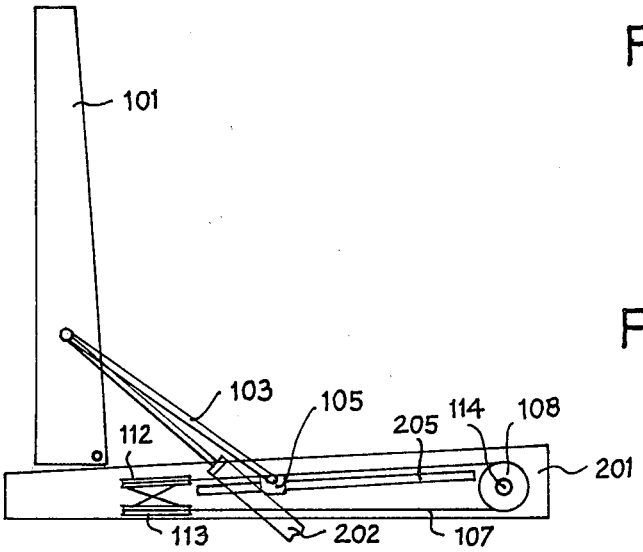

A first embodiment of a casting table having a device according to the theoretical diagram of FIG. 1 is shown in the casting position in FIG. 2 and in the mold stripping position in FIG. 3.

Table 101 rests for casting on frame 201 which supports pulleys 108 to 113. Pulleys 108 and 109 are carried by the transverse shaft 114 seen from the end in the figures. This shaft is parallel to axis 102, (formed possibly by a multielement pivot) about which table 101 pivots and which is itself supported by frame 201.

Two jacks, only one of which 202 is shown in the figures, are pivotably mounted by their body to frame 201 and by their head to the lower face of table 101. The lower parts of these jacks may plunge into a pit provided under the frame. During their extension, the jacks push the casting table from the position shown in FIG. 2 to the position shown in FIG. 3.

The funicular cable extends over the kinematic path defined by pulleys 108 to 113. Two synchronization carriages 105 and 106, of which only carriage 105 has been shown, are fixed to this cable and bear on two rails, of which only rail 205 has been shown, which extends between pulley 108 and pulley 112 under the corresponding strand of the funicular cable. A link 103 is pivotably mounted between carriage 105 and the bearing point of jack 202 on table 101. This arrangement simplifies the pivotable mounting of the link and the jack head on the table by joining them together on the same axis, which is not an obligation.

In this first embodiment, pivot 102 permanently supports the weight of the casting table and of the panel which is cast thereon. During the casting operations, the concrete is vibrated so as to make it more homogeneous and these vibrations are transmitted more especially by pivot 102.

Figure 5:
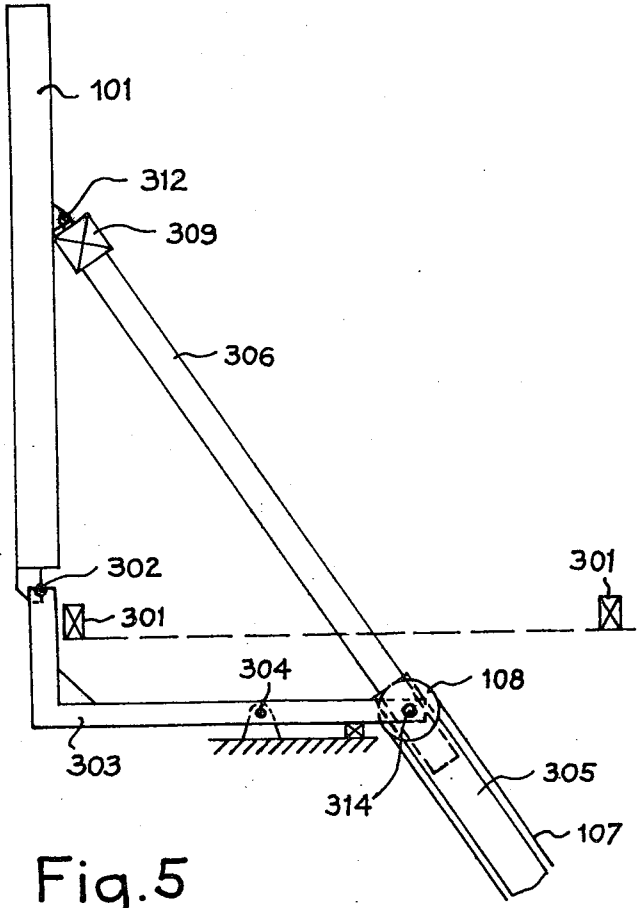
Figure 4:
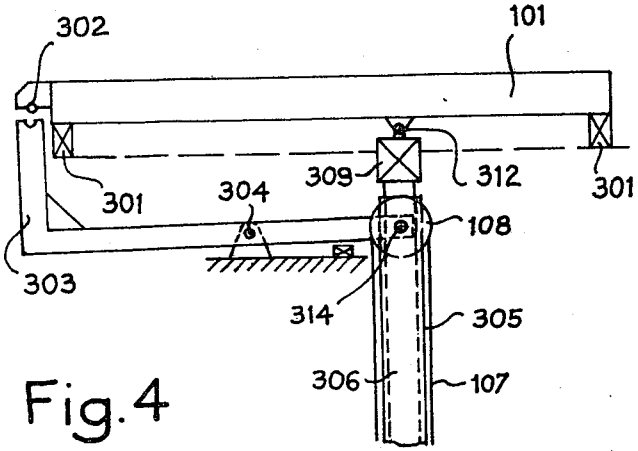
Figure 6:
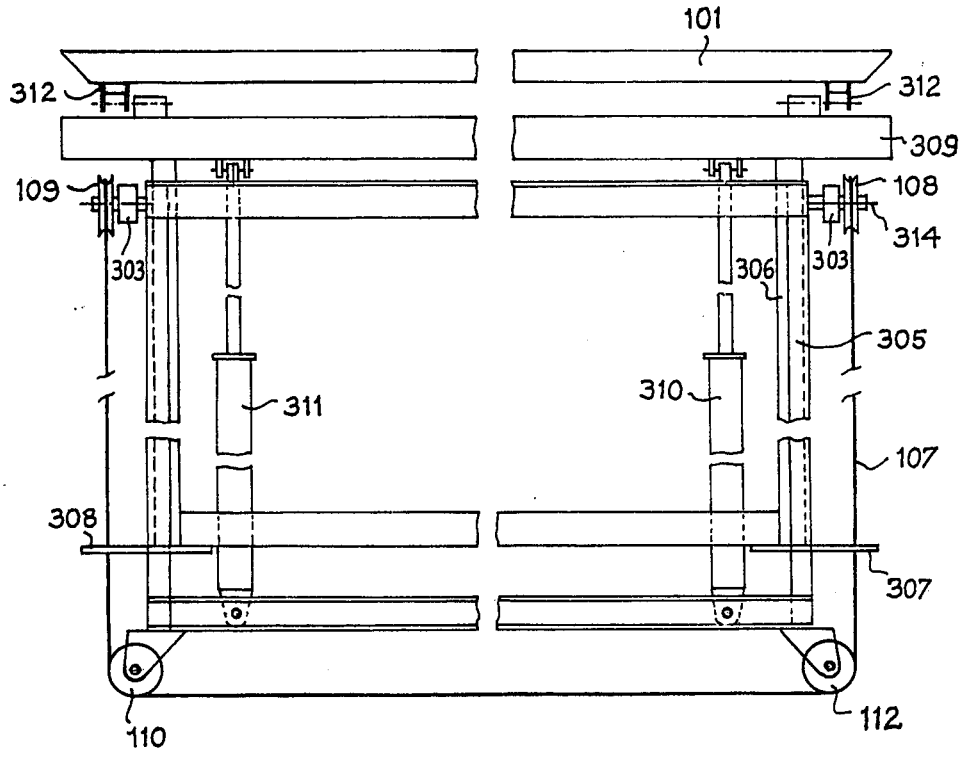

In a second embodiment, shown in the casting position in a front view and in a side view in FIGS. 4 and 6, and in the mold stripping position in a side view in FIG. 5 table 101 rests during all the casting operations, including the vibrating step, on rest stops 301 which are provided so as not to transmit vibrations. Pivot 302 is itself separated into two parts, one which is integral with table 101 and the other which is integral with a rocker 303. This rocker comprises at least two identical elements situated at each end of the table. Each element is L shaped, one arm of which extends upwardly and carries one of the parts of the pivot and the other arm of which extends horizontally under the table while being pivotably mounted on a second substantially median pivot 304 which allows a slight free motion thereof for freeing pivot 302 outside the mold stripping operations. This pivot 304 may be offset according to a design diagram.

The end of this horizontal part of the rocker opposite the vertical part comprises a horizontal axis 314 parallel to pivot 302, to which are keyed two synchronization pulleys 108 and 109. This axis also supports a fixed rectangular frame 305 which may swing about one of its sides about axis 314 and the lower side of which opposite this axis supports four pulleys 110 to 113 defining with pulleys 108 and 109 the kinematic path of the synchronization cable 107. The strands of this cable cross at the bottom of the fixed frame between pulleys 110 and 113. Inside the lateral sides of the fixed frame, which are in the form of a gutter, slide two lateral sides of a mobile frame 306, itself rectangular. The lower side of this mobile frame comprises two parts 307 and 308 which project from the fixed frame for fixing to the two lateral strands of cable 107 which move in the same direction in the movement of this cable. These parts form synchronization take-offs similar to carriages 105 and 106 of the first embodiment. Thus, the mobile frame will move with a motion parallel to itself in the fixed frame upwards or downwards without any tendency to skewing and while exerting an equal thrust along the whole of its upper part.

This upper part is formed by a thrust bar 309 which is connected to the lower part of the fixed frame through an assembly of jacks 310 and 311 for pushing this thrust bar, and so the whole of the mobile frame, upwards, synchronization being provided by the device comprising the funicular cable. It should be noted that, as in the first embodiment, these jacks are only one example of the lifting means. These may be very varied and comprise for example hoisting gear.

When the slab has been cast and after treatment it is ready to be removed from the mold. The jacks are actuated and cause the thrust bar to rise in abutment against table 101 through a third set of pivots 312. The table and the thrust bar are then locked firmly together.

When these pivots 312 begin to bear on the casting table, it is first of all the fixed frame which moves down while taking with it rocker 303 since these parts are the lightest. The movement of rocker 303 ends when the two parts of pivot 302 come into contact. Table 101 then rises from its rest stop 301 and begins to swing about the pivot 302 to the vertical position.

During the whole movement for raising the table, the fixed frame and all the members which it supports themselves pivot about axis 314 so as to continue to exert the thrust through bar 309 and pivots 312 on the casting table. The movement finishes when the table is vertical.

In this second embodiment, it is just as easy as in the first one to provide, for a very long casting table, an assembly of devices synchronized by means of shaft 314. Thus, the thrust beam 309 will be advantageously common to the whole of the mobile frames 306 while extending over the whole length of the devices placed side by side.

It is clear that these two embodiments comprise accessory members which are known per se and which allow the free movements to be limited so as to ensure the safety of the assembly. These members comprise more especially stops for preventing the table from overturning when it is vertical and automatic bolts for interlocking the elements of pivots 302 and 312.

What is claimed is:

1. In a device for raising a casting table, means for raising the table by causing said table to pivot about a first pivot axis parallel to one of its sides, comprising:

two synchronization pulleys having axes parallel to the pivot axis of said table;

two first change of direction pulleys;

two second change of direction pulleys;

a funicular cable mounted on said pulleys and having between respectively the synchronization pulleys and the first change of direction pulleys two synchronization strands perpendicular to the pivot axis and situated in a common plane, and between respectively the first and the second change of direction pulleys two other crossed strands so that the synchronization strands move in a common direction between the synchronization pulleys and the first change of direction pulleys;

two synchronization take-offs fixed respectively to the synchronization strands at an equal distance from the synchronization pulleys; and rigid connection means fixed at one end to the synchronization take-offs and at the other end thereof to the casting table.

2. The device as claimed in claim 1, wherein said change of direction pulleys are disposed fixedly under said table substantially at a common level with said synchronization pulleys, the synchronization take-offs comprise two carriages slidable along rails parallel to said synchronization strands, and the connection means comprise two links of an equal length mounted on the one end to the carriages and at the other end to the bottom of the table.

3. The device as claimed in claim 1, wherein there are further provided:

an L shaped rocker placed under the table, having at least two substantially vertical arms comprising at their free ends members capable of forming with complementary members carried by the casting table a pivot thereof, and at least two substantially horizontal arms carrying at their free end the axes of the synchronization pulleys and capable of swinging about a second pivot parallel to the pivot of the table; and situated at a point on said horizontal arms:

a rectangular fixed frame capable of pivoting along a first side about the axes of said synchronization pulleys and supporting at the ends of a second side parallel to this first side said change of direction pulleys; and a mobile rectangular frame forming part of the rigid connection means, having two lateral sides capable of sliding in two other sides of said fixed frame; said lateral sides carrying at their end turned towards the change of direction pulleys connection means, fixed to said synchronization strands of said funicular cable and forming the synchronization take-offs, and at their other end a thrust bar adapted to bear and to lock on an assembly of third pivots situated on the underneath of the casting table.

4. The device as claimed in claim 3, wherein said raising means comprise at least one jack which bears both on the second side of said fixed frame and on said thrust bar.

5. The device as claimed in any one of claims 1 to 4, wherein said synchronization pulleys are integral with a common shaft and comprise a self-blocking V-shaped groove.

6. The device as claimed in claim 5, wherein an assembly of identical devices is provided connected together by the shaft common to all said synchronization pulleys of said devices.

* * * * *